US005276001A

United States Patent [19]

Tsuchida et al.

[11] Patent Number: 5,276,001

[45] Date of Patent: Jan. 4, 1994

[54] HEAT SENSITIVE RECORDING MATERIAL

[75] Inventors: Tetsuo Tsuchida, Takarazuka; Takehiro Minami, Osaka; Tatsuya Meguro, Nishinomiya, all of Japan

[73] Assignee: Kanzaki Paper Manufacturing Co., Ltd., Tokyo, Japan

[21] Appl. No.: 848,771

[22] Filed: Mar. 10, 1992

[30] Foreign Application Priority Data

Mar. 11, 1991 [JP] Japan ..... 3-045221

[51] Int. Cl.[5] ..... B41M 5/30; B41M 5/32

[52] U.S. Cl. ..... 503/210; 427/152; 503/200; 503/211; 503/212; 503/216; 503/226

[58] Field of Search ..... 503/210, 212, 216, 225, 503/200, 211, 226; 427/152

[56] References Cited

U.S. PATENT DOCUMENTS

| | | | |
|---|---|---|---|
| 4,812,438 | 3/1989 | Yamori et al. | 503/200 |
| 4,833,116 | 5/1989 | Yamori et al. | 503/200 |
| 5,094,999 | 3/1992 | Tsuchida et al. | 503/216 |
| 5,096,872 | 3/1992 | Tsuchida et al. | 503/216 |

FOREIGN PATENT DOCUMENTS 0403833 12/1990 European Pat. Off. .

*Primary Examiner*—Pamela R. Schwartz
*Attorney, Agent, or Firm*—Nikaido, Marmelstein, Murray & Oram

[57] ABSTRACT

The present invention provides a heat sensitive recording material comprising a heat sensitive recording layer formed on a substrate and containing a color former and a color developer reactive with the color former, an intermediate layer formed on the recording layer and containing a water-soluble resin or water-dispersible resin, and an overcoat layer formed on the intermediate layer and containing a resin curable with an ionizing radiation, the heat sensitive recording material being characterized in that the color developer comprises at least one of a salicylic acid derivative represented by the following formula (1) or formula (2) and polyvalent metal salt of the derivative

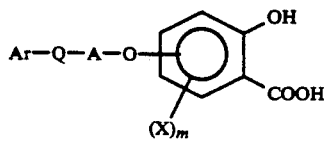

(1)

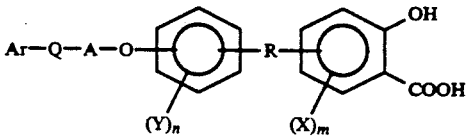

(2)

wherein Ar, Q, A, R, X, Y, m and n are defined in the specification.

9 Claims, No Drawings

HEAT SENSITIVE RECORDING MATERIAL

The present invention relates to heat sensitive recording materials, and more particularly to heat sensitive recording materials which have a high image density, high gloss and excellent gradiation recording properties and which is also excellent in storage stability and preservability of recorded images.

Heat sensitive recording materials are well known which utilize a color forming reaction between a color former and a color developer which produces a color when brought into contact therewith, the material thus forming color images when the two substances are contacted with each other. Such heat sensitive recording materials are relatively inexpensive and are used with a recording device which is compact and relatively easy to maintain. These recording materials are therefore used as recording media for facsimile systems, calculators and computers and have found wide use as heat sensitive labels, etc. However, they are low in resistance to fingerprints and solvents. For example, human sebum or solvent, when coming into contact with the recording layer, reduces the image density or causes undesired color formation, i.e., so-called background fogging. It is proposed in U.S. Pat. No. 4,812,438 that this drawback can be overcome by providing an intermediate layer of aqueous resin over the heat sensitive recording layer and thereafter forming on the intermediate layer an overcoat layer containing a resin which is curable with electron rays, and that the recording material thus constructed have improved preservability of recorded images, surface characteristics suited to wide use and excellent recording characteristics.

On the other hand, use has recently been made of various printers, such as video printers, which provide images of high qualities comparable to photographs. Even with regard to heat sensitive recording materials for printing out, it is required to develop those which are excellent in the density and gradiation of recorded images. For this purpose, efforts have been directed to the development of heat sensitive recording materials wherein a plastics film or synthetic paper is used as the substrate. Further a heat sensitive recording material for use in such video printers is also required to have an excellent storage stability and preservability of recorded images. For this purpose, it is proposed in U.S. Pat. No. 4,833,116 that a heat sensitive recording material which comprises a heat sensitive recording layer formed on a substrate made of a plastics film or synthetic paper, an intermediate layer containing a water-soluble resin or water-dispersible resin formed on the recording layer and an overcoat layer containing a resin curable with electron rays formed on the intermediate layer.

Nevertheless, even the recording material having the above-mentioned excellent characteristics still remains to be improved in properties. For example, when the recording material is used for video printers for producing record images of photographic tone, the recording material has the drawback that the halftone is prone to fading in a high-temperature and/or high-humid atmosphere, particularly in high-humid atmosphere, so that the material needs to be further improved in the preservability of recorded images. The term "halftone" means color density area of recorded images which are printed at relatively low thermal energy and have color density of 0.2 to 1.0 by Macbeth densitometer.

Moreover, the resin which is curable with electron rays could cause fogging of the recording layer even if an intermediate layer is interposed therebetween. Accordingly, it is presently desired to provide a heat sensitive recording material which is free of fogging and which has a high degree of whiteness.

An object of the present invention is to overcome the foregoing problems and to provide a heat sensitive recording material which has a high image density, high gloss, excellent gradiation recording properties and high storage stability free of fogging and which is also excellent in the preservability of recorded images, especially in the preservability of halftone.

The above and other objects of the invention will become apparent from the following description.

The present invention provides a heat sensitive recording material comprising a heat sensitive recording layer formed on a substrate and containing a color former and a color developer reactive with the color former, an intermediate layer formed on the recording layer and containing a water-soluble resin or water-dispersible resin, and an overcoat layer formed on the intermediate layer and containing a resin curable with an ionizing radiation, the heat sensitive recording material being characterized in that the color developer comprises at least one of a salicylic acid derivative represented by the following formula (1) or formula (2) and polyvalent metal salt of the derivative

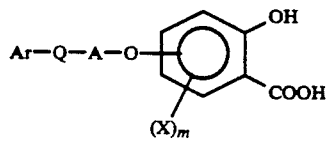

(1)

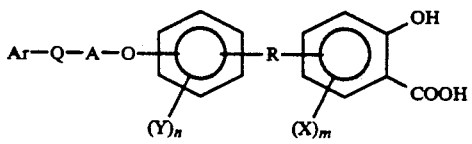

(2)

wherein Ar is phenyl having or not having a substituent, naphthyl having or not having a substituent or a heterocyclic aromatic group having or not having a substituent, Q is an ether linkage or sulfonyl linkage, A is branched or straight-chain alkylene having or not having an ether linkage, ester linkage, amide linkage or unsaturated bond, cycloalkylene having or not having an ether linkage, ester linkage or amide linkage, or alkylene having an arylene bond, and having or not having an ether linkage, ester linkage or amide linkage, R is branched or unbranched alkylene, X is a hydrogen atom, alkyl, cycloalkyl, alkenyl, aralkyl, aryl, alkoxyl, aryloxy, nitro or halogen atom, Y is a hydrogen atom, alkyl, alkenyl, aralkyl or halogen atom, m is an integer of I to 3, and n is an integer of 1 to 4.

Incidentally in the definition of the formulae 1 and 2, like substituents are represented by like symbols merely to avoid repeated description of these substituents.

In the formula 1 or 2 representing salicylic acid derivatives, Ar is phenyl which may have a substituent, naphthyl which may have a substituent or a heterocyclic aromatic group which may have a substituent. Especially preferable among these groups is phenyl which may have a substituent. Examples of preferred substituents for the phenyl group are an alkyl, cycloalkyl, alkenyl, aryl, aralkyl, alkoxyl, alkylthio, aryloxy, aralkyloxy, arylcarbonyl, aryloxycarbonyl, alkoxycarbonyl, alkylcarbonyl, alkylcarbonyloxy, nitro, hydroxyl arid halogen atom. More preferable among these are $C_{1\sim6}$ alkyl groups, $C_{1\sim6}$ alkoxyl groups, $C_{7\sim10}$ aralkyl groups, $C_{7\sim10}$ aralkyloxy groups, chlorine atom, bromine atom and fluorine atom. Among these, most preferable are $C_{1\sim4}$ alkyl groups, $C_{1\sim4}$ alkoxyl groups and chlorine atom.

In the formula 1 or 2 representing salicylic acid derivatives, Q is an ether linkage or sulfonyl linkage. A is branched or straight-chain alkylene which may have an ether linkage, ester linkage, amide linkage or unsaturated bond, cycloalkylene which may have an ether linkage, ester linkage or amide linkage, or aklylene having an arylene bond, and which may have an ether linkage, ester linkage or amide linkage. Among these, more preferable are $C_{1\sim12}$ alkylene groups which may have an ether linkage, and most preferable are $C_{2\sim6}$ alkylene groups. In the formula 2, R is branched or unbranched alkylene group which preferably has 1 to 12 carbon atoms and more preferably has 2 to 6 carbon atoms.

In the formula 1 or 2, X is a hydrogen atom, alkyl, cycloalkyl, alkenyl, aralkyl, aryl, alkoxyl, aryloxy, nitro or halogen atom. Preferable among these are hydrogen atom, $C_{1\sim20}$ alkyl groups, $C_{5\sim7}$ cycloalkyl groups, $C_{2\sim6}$ alkenyl groups, $C_{7\sim10}$ aralkyl groups, $C_{1\sim20}$ alkoxyl groups, phenyl group, naphthyl group, phenoxy group, nitro group and halogen atom. More preferable are hydrogen atom, $C_{1\sim6}$ alkyl groups, $C_{7\sim10}$ aralkyl groups, $C_{1\sim6}$ alkoxyl groups, phenyl group, phenoxy group, chlorine atom, bromine atom and fluorine atom. Most preferable is hydrogen atom. Y is a hydrogen atom, alkyl, alkenyl, aralkyl or halogen atom. Among these, preferable are hydrogen atom, $C_{1\sim6}$ alkyl groups, $C_{2\sim6}$ alkenyl groups, $C_{7\sim10}$ aralkyl groups, chlorine atom, bromine atom and fluorine atom. More preferable is hydrogen atom. Further m is an integer of 1 to 3, and n is an integer of 1 to 4.

According to the present invention, the salicylic acid represented by the formula 1 or 2 or a polyvalent metal salt thereof is used as a color developer. The salt forming metal is preferably a bivalent, trivalent or tetravalent metal. Examples of more preferable metals are zinc, calcium, aluminum, magnesium, tin and iron. Most preferable metal is zinc.

The followings are examples of salicylic acid derivatives represented by the formula 1.

4-phenylsulfonylmethoxysalicylic acid,
5-phenylsulfonylmethoxysalicylic acid,
4-(2-phenylsulfonylethoxy)salicylic acid,
5-(2-phenylsulfonylethoxy)salicylic acid,
4-(3-phenylsulfonylpropyloxy)salicylic acid,
5-(3-phenylsulfonylpropyloxy)salicylic acid,
4-(4-phenylsulfonylbutyloxy)salicylic acid,
5-(4-phenylsulfonylbutyloxy)salicyiic acid,
4-(5-phenylsulfonylpentyloxy)salicylic acid,
5-(5-phenylsulfonylpentyloxy)salicylic acid,
4-(6-phenylsulfonylhexyloxy)salicylic acid,
5-(6-phenylsulfonylhexyloxy)salicylic acid,
4-(8-phenylsulfonyloctyloxy)salicylic acid,
5-(8-phenylsulfonyloctyloxy)salicylic acid,
4-(10-phenylsulfonyldecyloxy)salicylic acid,
5-(10-phenylsulfonyldecyloxy)salicylic acid,
4-(12-phenylsulfonyldodecyloxy)salicylic acid,
5-(12-phenylsulfonyldodecyloxy)salicylic acid,
4-(18-phenylsulfonyloctadecyloxy)salicylic acid,
5-(18-phenylsulfonyloctadecyloxy)salicylic acid,
4-(1-methyl-1-phenylsulfonylmethoxy)salicylic acid,
5-(1-methyl-1-phenylsulfonylmethoxy)salicylic acid,
4-(1,1-dimethyl-1-phenylsulfonylmethoxy)salicylic acid,
5-(1,1-dimethyl-1-phenylsulfonylmethoxy)salicylic acid,
4-(5-phenylsulfonyl-3-oxa-pentyloxy)salicylic acid,
5-(5-phenylsulfonyl-3-oxa-pentyloxy)salicylic acid,
4-(8-phenylsulfonyl-3,6-dioxa-octyloxy)salicylic acid,
5-(8-phenylsulfonyl-3,6-dioxa-octyloxy)salicylic acid,
4-(11-phenylsulfonyl-3,6,9-trioxa-undecyloxy)salicylic acid,
5-(11-phenylsulfonyl-3,6,9-trioxa-undecyloxy)salicylic acid,
4-(7-phenylsulfonyl-3,5-dioxa-heptyloxy)salicylic acid,
5-(7-phenylsulfonyl-3,5-dioxa-heptyloxy)salicylic acid,
4-(9-phenylsulfonyl-5-oxa-nonyloxy)salicylic acid,
5-(9-phenylsulfonyl-5-oxa-nonyloxy)salicylic acid,
4-(3-phenylsulfonyl-1-propenyloxy)salicylic acid,
5-(3-phenylsulfonyl-1-propenyloxy)salicylic acid,
4-(4-phenylsulfonyl-2-butenyloxy)salicylic acid,
5-(4-phenylsulfonyl-2-butenyloxy)salicylic acid,
4-(2-phenyl-3-phenylsulfonylpropyloxy)salicylic acid,
5-(2-phenyl-3-phenylsulfonylpropyloxy)salicylic acid,
4-(4-phenylsulfonylmethylbenzyloxy)salicylic acid,
5-(4-phenylsulfonylmethylbenzyloxy)salicylic acid,
4-(3-phenylsulfonylmethylbenzyloxy)salicylic acid,
5-(3-phenylsulfonylmethylbenzyloxy)salicylic acid,
4-(4-phenylsulfonylphenoxy)salicylic acid,
5-(4-phenylsulfonylphenoxy)salicylic acid,
4-(3-phenylsulfonylphenoxy)salicylic acid,
5-(3-phenylsulfonylphenoxy)salicylic acid,
4-(2-cyclohexyl-3-phenylsulfonylpropyloxy)salicylic acid,
5-(2-cyclohexyl-3-phenylsulfonylpropyloxy)salicylic acid,
4-(2-phenylsulfonylacetoxyethoxy)salicylic acid,
5-(2-phenylsulfonylacetoxyethoxy)salicylic acid,
4-(3-phenylsulfonylacetoxypropyloxy)salicylic acid,
5-(3-phenylsulfonylacetoxypropyloxy)salicylic acid,
4-(3-phenylsulfonylpropionyloxymethoxy)salicylic acid,
5-(3-phenylsulfonylpropionyloxymethoxy)salicylic acid,
4-(2-methoxycarbonyl-2-phenylsulfonylethoxy)salicylic acid,
5-(2-methoxycarbonyl-2-phenylsulfonylethoxy)salicylic acid,
4-(2-phenylsulfonylacetylaminoethoxy)salicylic acid,
5-(2-phenylsulfonylacetylaminoethoxy)salicylic acid,
4-(3-phenylsulfonylpropionylaminomethoxy)salicylic acid,
5-(3-phenylsulfonylpropionylaminomethoxy)salicylic acid,
4-(5-phenylsulfonyl-3-thio-pentyloxy)salicylic acid,
5-(5-phenylsulfonyl-3-thio-pentyloxy)salicylic acid,
4-[2-(3-phenylsulfonylpropionyl)ethoxy]salicylic acid,
5-[2-(3-phenylsulfonylpropionyl)ethoxy]salicylic acid,
4-(p-tolylsulfonylmethoxy)salicylic acid,
5-(p-tolylsulfonylmethoxy)salicylic acid,
4-(2-p-tolylsulfonylethoxy)salicylic acid,
5-(2-p-tolylsulfonylethoxy)salicylic acid,
4-(3-p-tolylsulfonylpropyloxy)salicylic acid,
5-(3-p-tolylsulfonylpropyloxy)salicylic acid,
4-(4-p-tolylsulfonylbutyloxy)salicylic acid,
5-(4-p-tolylsulfonylbutyloxy)salicylic acid,
4-(5-p-tolylsulfonylpentyloxy)salicylic acid, 5-(5-p-tolylstilfonylpentyloxy)salicylic acid,
4-(6-p-tolylsulfonylhexyloxy)salicylic acid,
5-(6-p-tolylsulfonylhexyloxy)salicylic acid,
4-(8-p-tolylsulfonyloctyloxy)salicylic acid,
5-(8-p-tolylsulfonyloctyloxy)salicylic acid,
4-(10-p-tolylsulfonyldecyloxy)salicylic acid,
5-(10-p-tolylsulfonyldecyloxy)salicylic acid,
4-(12-p-tolylsulfonyldodecyloxy)salicylic acid,
5-(12-p-tolylsulfonyldodecyloxy)salicylic acid,
4-(18-p-tolylsulfonyloctadecyloxy)salicylic acid,
5-(18-p-tolylsulfonyloctadecyloxy)salicylic acid,
4-(1-methyl-1-p-tolylsulfonylmethoxy)salicylic acid,
5-(1-methyl-1-p-tolylsulfonylmethoxy)salicylic acid,
4-(1,1-dimethyl-1-p-tolylsulfonylmethoxy)salicylic acid,
5-(1,1-dimethyl-1-p-tolylsulfonylmethoxy)salicylic acid,
4-(5-p-tolylsulfonyl-3-oxa-pentyloxy)salicylic acid,
5-(5-p-tolylsulfonyl-3-oxa-pentyloxy)salicylic acid,
4-(8-p-tolylsulfonyl-3,6-dioxa-octyloxy)salicylic acid,
5-(8-p-tolylsulfonyl-3,6-dioxa-octyloxy)salicylic acid,
4-(11-p-tolylsulfonyl-3,6,9-trioxa-undecyloxy)salicylic acid,
5-(11-p-tolylsulfonyl-3,6,9-trioxa-undecyloxy)salicylic acid,
4-(7-p-tolylsulfonyl-3,5-dioxa-heptyloxy)salicylic acid,
5-(7-p-tolylsulfonyl-3,5-dioxa-heptyloxy)salicylic acid,
4-(9-p-tolylsulfonyl-5-oxa-nonyloxy)salicylic acid,
5-(9-p-tolylsulfonyl-5-oxa-nonyloxy)salicylic acid,
4-(3-p-tolylsulfonyl-l-propenyloxy)salicylic acid,
5-(3-p-tolylsulfonyl-l-propenyloxy)salicylic acid,
4-(4-p-tolylsulfonyl-2-butenyloxy)salicylic acid,
5-(4-p-tolylsulfonyl-2-butenyloxy)salicylic acid,
4-(2-phenyl-3-p-tolylsulfonylpropyloxy)salicylic acid,
5-(2-phenyl-3-p-tolylsulfonylpropyloxy)salicylic acid,
4-(4-p-tolylsulfonylmethylbenzyloxy)salicylic acid,
5-(4-p-tolylsulfonylmethylbenzyloxy)salicylic acid,
4-(3-p-tolylsulfonylmethylbenzyloxy)salicylic acid,
5-(3-p-tolylsulfonylmethylbenzyloxy)salicylic acid,
4-(4-p-tolylsulfonylphenoxy)salicylic acid,
5-(4-p-tolylsulfonylphenoxy)salicylic acid,
4-(3-p-tolylsulfonylphenoxy)salicylic acid,
5-(3-p-tolylsulfonylphenoxy)salicylic acid,
4-(2-cyclohexyl-3-p-tolylsulfonylpropyloxy)salicylic acid,
5-(2-cyclohexyl-3-p-tolylsulfonylpropyloxy)salicylic acid,
4-(4-p-tolylsulfonylcyclohexyloxy)salicylic acid,
5-(4-p-tolylsulfonylcyclohexyloxy)salicylic acid,
4-(2-o-tolylsulfonylethoxy)salicylic acid,
5-(2-o-tolylsulfonylethoxy)salicylic acid,
4-(2-m-tolylsulfonylethoxy)salicylic acid,
5-(2-m-tolylsulfonylethoxy)salicylic acid,
4-(2-p-ethylphenylsulfonylethoxy)salicylic acid,
5-(2-p-ethylphenylsulfonylethoxy)salicylic acid,
4-(2-p-propylphenylsulfonylethoxy)salicylic acid,
5-(2-p-propylphenylsulfonylethoxy)salicylic acid,
4-(2-p-isopropylphenylsulfonylethoxy)salicylic acid,
5-(2-p-isopropylphenylsulfonylethoxy)salicylic acid,
4-(2-p-hexylphenylsulfonylethoxy)salicylic acid,
5-(2-p-hexylphenylsulfonylethoxy)salicylic acid,
4-(2-p-methoxyphenylsulfonylethoxy)salicylic acid,
5-(2-p-methoxyphenylsulfonylethoxy)salicylic acid,
4-(2-o-methoxyphenylsulfonylethoxy)salicylic acid,
5-(2-o-methoxyphenylsulfonylethoxy)salicylic acid,
4-(2-m-methoxyphenylsulfonylethoxy)salicylic acid,
5-(2-m-methoxyphenylsulfonylethoxy)salicylic acid,
4-(2-p-ethoxyphenylsulfonylethoxy)salicylic acid,
5-(2-p-ethoxyphenylsulfonylethoxy)salicylic acid,
4-(2-p-isopropyloxyphenylsulfonylethoxy)salicylic acid,
5-(2-p-isopropyloxyphenylsulfonylethoxy)salicylic acid,
4-(2-p-butyloxyphenylsulfonylethoxy)salicylic acid,
5-(2-p-butyloxyphenylsulfonylethoxy)salicylic acid,
4-(2-p-hexyloxyphenylsulfonylethoxy)salicylic acid,
5-(2-p-hexyloxyphenylsulfonylethoxy)salicylic acid,
4-(3-p-methoxyphenoxypropyloxy)salicylic acid,
5-(3-p-methoxyphenoxypropyloxy)salicylic acid,
4-(3-p-isopropyloxyphenoxypropyloxy)salicylic acid,
5-(3-p-isopropyloxyphenoxypropyloxy)salicylic acid,
4-(3-tert-butyloxyphenoxypropyloxy)salicylic acid,
5-(3-tert-butyloxyphenoxypropyloxy)salicylic acid,
4-(4-p-methoxyphenoxybutyloxy)salicylic acid,
5-(4-p-methoxyphenoxybutyloxy)salicylic acid,
4-(4-p-isopropyloxyphenoxybutyloxy)salicylic acid,
5-(4-p-isopropyloxyphenoxybutyloxy)salicylic acid,
4-(2-p-biphenylsulfonylethoxy)salicylic acid,
5-(2-p-biphenylsulfonylethoxy)salicylic acid,
4-(2-o-biphenylsulfonylethoxy)salicylic acid,
5-(2-o-biphenylsulfonylethoxy)salicylic acid,
4-(2-m-biphenylsulfonylethoxy)salicylic acid,
5-(2-m-biphenylsulfonylethoxy)salicylic acid,
4-(2-p-phenoxyphenylsulfonylethoxy)salicylic acid,
5-(2-p-phenoxyphenylsulfonylethoxy)salicylic acid,
4-(2-p-chlorophenylsulfonylethoxy)salicylic acid,
5-(2-p-chlorophenylsulfonylethoxy)salicylic acid,
4-(3-p-chlorophenylsulfonylpropyloxy)salicylic acid,
5-(3-p-chlorophenylsulfonylpropyloxy)salicylic acid,
4-(4-p-chlorophenylsulfonylbutoxy)salicylic acid,
5-(4-p-chlorophenylsulfonylbutoxy)salicylic acid,
4-(2-o-chlorophenylsulfonylethoxy)salicylic acid,
5-(2-o-chlorophenylsulfonylethoxy)salicylic acid,
4-(2-p-bromophenylsulfonylethoxy)salicylic acid,
5-(2-p-bromophenylsulfonylethoxy)salicylic acid,
4-(2-p-fluorophenylsulfonylethoxy)salicylic acid,
5-(2-p-fluorophenylsulfonylethoxy)salicylic acid,
4-(2-p-cyclohexylphenylsulfonylethoxy)salicylic acid,
5-(2-p-cyclohexylphenylsulfonylethoxy)salicylic acid,
4-(2-p-allylphenylsulfonylethoxy)salicylic acid,
5-(2-p-allylphenylsulfonylethoxy)salicylic acid,
4-(2-p-benzylphenylsulfonylethoxy)salicylic acid,
5-(2-p-benzylphenylsulfonylethoxy)salicylic acid,
4-(2-p-methylthiophenylsulfonylethoxy)salicylic acid,
5-(2-p-methylthiophenylsulfonylethoxy)salicylic acid,
4-(2-p-benzyloxyphenylsulfonylethoxy)salicylic acid,
5-(2-p-benzyloxyphenylsulfonylethoxy)salicylic acid,
4-(2-p-phenethyloxyphenylsulfonylethoxy)salicylic acid,
5-(2-p-phenethyloxyphenylsulfonylethoxy)salicylic acid,
4-(2-p-methoxycarbonylphenylsulfonylethoxy)salicylic acid,
5-(2-p-methoxycarbonylphenylsulfonylethoxy)salicylic acid,
4-(2-p-acetylphenylsulfonylethoxy)salicylic acid,
5-(2-p-acetylphenylsulfonylethoxy)salicylic acid,
4-(2-p-benzoylphenylsulfonylethoxy)salicylic acid,
5-(2-p-benzoylphenylsulfonylethoxy)salicylic acid,
4-(2-p-acetyloxyphenylsulfonylethoxy)salicylic acid,
5-(2-p-acetyloxyphenylsulfonylethoxy)salicylic acid,
4-(2-p-nitrophenylsulfonylethoxy)salicylic acid,
5-(2-p-nitrophenylsulfonylethoxy)salicylic acid,
4-(2-p-hydroxyphenylsulfonylethoxy)salicylic acid,
5-(2-p-hydroxyphenylsulfonylethoxy)salicylic acid,
4-(2-m-hydroxyphenylsulfonylethoxy)salicylic acid, 5-(2-m-hydroxyphenylsulfonylethoxy)salicylic acid,
4-[2-(3,5-dimethylphenylsulfonyl)ethoxy]salicylic acid,
5-[2-(3,5-dimethylphenylsulfonyl)ethoxy]salicylic acid,
4-[2-(3,4,5-trimethylphenylsulfonyl)ethoxy]salicylic acid,
5-[2-(3,4,5-trimethylphenylsulfonyl)ethoxy]salicylic acid,
4-[2-(3,5-dichlorophenylsulfonyl)ethoxy]salicylic acid,
5-[2-(3,5-dichlorophenylsulfonyl)ethoxy]salicylic acid,
4-[2-(3,4,5-trichlorophenylsulfonyl)ethoxy]salicylic acid,
5-[2-(3,4,5-trichlorophenylsulfonyl)ethoxy]salicylic acid,
4-[2-(3-chloro-4-methylphenylsulfonyl)ethoxy]salicylic acid,
5-[2-(3-chloro-4-methylphenylsulfonyl)ethoxy]salicylic acid,
4-[2-(1-naphthylsulfonyl)ethoxy]salicylic acid,
5-[2-(1-naphthylsulfonyl)ethoxy]salicylic acid,
4-[2-(4-methyl-1-naphthylsultonyl)ethoxy]salicylic acid,
5-[2-(4-methyl-1-naphthylsulfonyl)ethoxy]salicylic acid,
4-[2-(4-methoxy-1-naphthylsulfonyl)ethoxy]salicylic acid,
5-[2-(4-methoxy-1-naphthylsulfonyl)ethoxy]salicylic acid,
4-[2-(4-benzyloxy-1-naphthylsulfonyl)ethoxy]salicylic acid,
5-[2-(4-benzyloxy-1-naphthylsulfonyl)ethoxy]salicylic acid,
4-[2-(2-naphthylsulfonyl)ethoxy]salicylic acid,
5-[2-(2-naphthylsulfonyl)ethoxy]salicylic acid,
4-[2-(6-methyl-2-naphthylsulfonyl)ethoxy]salicylic acid,
5-[2-(6-methyl-2-naphthylsulfonyl)ethoxy]salicylic acid,
4-[2-(6-methoxy-2-naphthylsulfonyl)ethoxy]salicylic acid,
5-[2-(6-methoxy-2-naphthylsulfonyl)ethoxy]salicylic acid,
4-[2-(6-benzyloxy-2-naphthylsulfonyl)ethoxy]salicylic acid,
5-[2-(6-benzyloxy-2-naphthylsulfonyl)ethoxy]salicylic acid,
4-[2-(2-pyridylsulfonyl)ethoxy]salicylic acid,
5-[2-(2-pyridylsulfonyl)ethoxy]salicylic acid,
3-methyl-4-(2-p-tolylsulfonylethoxy)salicylic acid,
3-methyl-5-(2-p-tolylsulfonylethoxy)salicylic acid,
3,5-dimethyl-4-(2-p-tolylsulfonylethoxy)salicylic acid,
3-cyclohexyl-4-(2-p-tolylsulfonyleihoxy)salicylic acid,
3-allyl-4-(2-p-tolylsulfonylethoxy)salicylic acid,
3-α,α-dimethylbenzyl-4-(2-p-tolylsulfonylethoxy)salicylic acid,
3-phenyl-4-(2-p-tolylsulfonylethoxy)salicylic acid,
3-acetyloxy-4-(2-p-tolylsulfonylethoxy)salicylic acid,
3-phenoxy-4-(2-p-tolylsulfonylethoxy)salicylic acid,
4-chloro-5-(2-p-tolylsulfonylethoxy)salicylic acid,
5-chloro-4-(2-p-tolylsulfonylethoxy)salicylic acid,
4-bromo-5-(2-p-tolylsulfonylethoxy)salicylic acid,
5-bromo-4-(2-p-tolylsulfonylethoxy)salicylic acid,
3,5-dichloro-4-(2-p-tolylsulfonyleihoxy)salicylic acid,
3-methoxy-5-(2-p-tolylsulfonylethoxy)salicylic acid,
5-nitro-4-(2-p-tolylsulfonylethoxy)salicylic acid,
4-(2-phenoxyethoxy)salicylic acid,
5-(2-phenoxyethoxy)salicylic acid,
3-(2-phenoxyethoxy)salicylic acid,
4-(4-phenoxybutoxy)salicylic acid,
5-(4-phenoxybutoxy)salicylic acid,
4-(6-phenoxyhexyloxy)salicylic acid,
4-(5-phenoxyamyloxy)salicylic acid,
4-(8-phenoxyoctyloxy)salicylic acid,
4-(10-phenoxydecyloxy)salicylic acid,
4-(2-p-tolyloxyethoxy)salicylic acid,
5-(2-p-tolyloxyethoxy)salicylic acid,
4-(2-m-tolyloxyethoxy)salicylic acid,
4-(2-p-ethylphenoxyethoxy)salicylic acid,
4-(2-p-isopropylphenoxyethoxy)salicylic acid,
4-(2-p-tert-butylphenoxyethoxy)salicylic acid,
4-(2-p-cyclohexylphenoxyethoxy)salicylic acid,
4-(2-p-tert-octylphenoxyethoxy)salicylic acid,
4-(2-p-nonylphenoxyethoxy)salicylic acid,
4-(2-p-dodecylphenoxyethoxy)salicylic acid,
4-(2-p-benzylphenoxyethoxy)salicylic acid,
4-(2-p-α-phenethylphenoxyethoxy)salicylic acid,
4-(2-p-methoxyphenoxyethoxy)salicylic acid,
4-(2-p-cumyloxyethoxy)salicylic acid;
4-[2-(2,4-dimethylphenoxy)ethoxy]salicylic acid,
4-[2-(3,4-dimethylphenoxy)ethoxy]salicylic acid,
4-[2-(3,5-dimethylphenoxy)ethoxy]salicylic acid,
4-[2-(2,4-bis-α-phenethylphenoxy)ethoxy]salicylic acid,
4-(2-p-methoxyphenoxyethoxy)salicylic acid,
5-(2-p-methoxyphenoxyethoxy)salicylic acid,
4-(2-p-ethoxyphenoxyethoxy)salicylic acid,
4-(2-p-benzyloxyphenoxyethoxy)salicylic acid,
4-(2-p-dodecyloxyphenoxyethoxy)salicylic acid,
4-(2-p-chlorophenoxyethoxy)salicylic acid,
4-(2-p-phenylphenoxyethoxy)salicylic acid,
4-(2-p-cyclopentylphenoxyethoxy)salicylic acid,
4-(2-p-benzyloxycarbonylphenoxyethoxy)salicylic acid,
4-(2-p-dodecyloxycarbonylphenoxyethoxy)salicylic acid,
4-(2-β-naphthyloxyethoxy)salicylic acid,
4-(2-p-pentylphenoxyethoxy)salicylic acid,
4-(2-phenoxyethoxy)-6-methylsalicylic acid,
4-(2-phenoxyethoxy)-6-chlorosalicylic acid,
4-(3-phenoxyisopropyloxy)salicylic acid,
4-(5-p-methoxyphenoxy-3-oxa-pentyloxy)salicylic acid, etc.

The followings are examples of salicylic acid derivatives of the formula 2.

5-[p-(2-phenoxyethoxy)cumyl]salicylic acid,
5-[o-(2-phenoxyethoxy)cumyl]salicylic acid,
5-[m-(2-phenoxyethoxy)cumyl]salicylic acid,
3-[p-(2-phenoxyethoxy)cumyl]salicylic acid,
4-[p-(2-phenoxyethoxy)cumyl]salicylic acid,
5-[p-(3-phenoxypropoxy)cumyl]salicylic acid,
3-[p-(3-phenoxypropoxy)cumyl]salicylic acid,
5-[p-(4-phenoxybutoxy)cumyl]salicylic acid,
4-[p-(4-phenoxybutoxy)cumyl]salicylic acid,
5-[p-(5-phenoxy-3-oxa-pentyloxy)cumyl]salicylic acid,
5-[p-(9-phenoxy-3,6-dioxa-undecyloxy)cumyl]salicylic acid,
5-[p-(7-phenoxy-3,5-dioxa-heptyloxy)cumyl]salicylic acid,
5-[p-(2-p-methoxyphenoxyethoxy)cumyl]salicylic acid,
3-[p-(2-p-methoxyphenoxyethoxy)cumyl]salicylic acid,
4-[p-(2-p-methoxyphenoxyethoxy)cumyl]salicylic acid,
5-[o-(2-p-methoxyphenoxyethoxy)cumyl]salicylic acid,
5-[p-(2-p-ethoxyphenoxyethoxy)cumyl]salicylic acid,
5-[p-(2-p-isopropoxyphenoxyethoxy)cumyl]salicylic acid,
5-[p-(2-p-tert-butoxyphenoxyethoxy)cumyl]salicylic acid,
5-{p-[2-p-(2-methoxyethoxy)phenoxyethoxy]cumyl}salicylic acid, 5-[p-(3-p-methoxyphenoxypropoxy)cumyl]salicylic acid,
5-[p-(4-p-methoxyphenoxybutoxy)cumyl]salicylic acid,
5-[p-(5-p-methoxyphenoxy-3-oxa-pentyloxy)cumyl]salicylic acid,
5-[p-(2-p-tolyloxyethoxy)cumyl]salicylic acid,
3-[p-(2-p-ethylphenoxyethoxy)cumyl]salicylic acid,
4-[p-(2-p-chlorophenoxyethoxy)cumyl]salicylic acid,
5-[p-(2-p-bromophenoxyethoxy)cumyl]salicylic acid,
5-[p-(3-p-tolyloxypropoxy)cumyl]salicylic acid,
5-[p-(4-p-chlorophenoxybutoxy)cumyl]salicylic acid,
5-(p-benzyloxycumyl)salicylic acid,
5-(p-phenethyloxycumyl)salicylic acid,
5-[p-(2-β-naphthyloxyethoxy)cumyl]salicylic acid,
5-[p-(2-α-naphthyloxyethoxy)cumyl]salicylic acid,
5-[p-(3-p-tolylsulfonylpropoxy)cumyl]salicylic acid,
5-[p-(4-p-tolylsulfonylbutoxy)cumyl]salicylic acid,
5-[p-(3-phenylsulfonylpropoxy)cumyl]salicylic acid,
5-[p-(6-phenylsulfonylhexyloxy)cumyl]salicylic acid,
5-[p-(3-p-methoxyphenylsulfonylpropoxy)cumyl]salicylic acid,
5-[p-(4-p-methoxyphenylsulfonylbutoxy)cumyl]salicylic acid,
5-[p-(4-benzenesulfonylbutoxy)cumyl]salicylic acid,
5-[p-(6-p-chlorophenylsulfonylhexyloxy)cumyl]salicylic acid,
5-[p-(2-phenoxyethoxy)benzyl]salicylic acid,
3-[p-(2-phenoxyethoxy)benzyl]salicylic acid,
5-[p-(2-phenoxyethoxy)phenethyl]salicylic acid,
5-[3-(p-2-phenoxyethoxyphenyl)propyl]salicylic acid,
3-[4-(p-2-phenoxyethoxyphenyl)butyl]salicylic acid,
5-[6-(p-2-phenoxyethoxyphenyl)hexyl]salicylic acid,
5-[8-(p-2-phenoxyethoxyphenyl)octyl]salicylic acid,
5-[12-(p-2-phenoxyethoxyphenyl)dodecyl]salicylic acid,
5-[α-methyl-p-(2-phenoxyethoxy)benzyl]salicylic acid,
5-[α-methyl-α-ethyl-p-(2-phenoxyethoxy)benzyl]salicylic acid,
5-[α-methyl-α-isopropyl-p-(2-phenoxyethoxy)benzyl]-salicylic acid,
3-[α-methyl-α-isopropyl-p-(2-phenoxyethoxy)benzyl]-salicylic acid,
5-[α-methyl-α-isobutyl-p-(2-phenoxyethoxy)benzyl]-salicylic acid,
5-[p-(2-p-methoxyphenoxyethoxy)benzyl]salicylic acid,
5-[p-(2-p-methoxyphenoxyethoxy)phenethyl]salicylic acid,
5-[α-methyl-p-(2-p-methoxyphenoxyethoxy)benzyl]-salicylic acid,
5-[α-methyl-α-ethyl-p-(2-p-methoxyphenoxyethoxy)-benzyl]salicylic acid,
5-[α-methyl-α-isopropyl-p-(2-p-methoxyphenoxyethoxy)benzyl]salicylic acid,
5-[α-methyl-α-isobutyl-p-(2-p-methoxyphenoxyethoxy)benzyl]salicylic acid,
5-[p-(3-p-methoxyphenylsulfonylpropoxy)benzyl]salicylic acid,
5-[p-(3-phenylsulfonylpropoxy)phenethyl]salicylic acid,
5-[α-methyl-p-(3-p-tolylsulfonylpropoxy)benzyl]salicylic acid,
5-[α-methyl-α-ethyl-p-(3-p-chlorophenylsulfonylpropoxy)benzyl]salicylic acid,
5-[α-methyl-α-isopropyl-p-(3-p-tolylsulfonylpropoxy)-benzyl]salicylic acid,
5-(p-n-dodecyloxybenzyl)salicylic acid,
3-(p-n-octadecyloxybenzyl)salicylic acid,
5-(p-n-octadecyloxyphenethyl)salicylic acid,
5-(α-methyl-p-n-octadecyloxybenzyl)salicylic acid,
5-(α-methyl-α-isopropyl-p-n-dodecyloxybenzyl)salicylic acid,
5-(α-methyl-α-isobutyl-p-isopropoxybenzyl)salicylic acid,
5-(1-p-methoxyphenylcyclohexyl)salicylic acid,
5-[p-(3-p-tolylsulfonylpropoxy)benzyl]salicylic acid,
5-(α-methyl-α-isopropyl-p-(3-p-tolylsulfonylpropoxy)-benzyl]salicylic acid,
5-[m-methyl-p-(2-phenoxyethoxy)cumyl]salicylic acid,
5-[m-ethyl-p-(2-phenoxyethoxy)cumyl]salicylic acid,
5-[m-tert-butyl-p-(2-phenoxyethoxy)cumyl]salicylic acid,
5-[m-vinyl-p-(2-phenoxyethoxy)cumyl]salicylic acid,
5-[m-allyl-p-(2-phenoxyethoxy)cumyl]salicylic acid,
5-[m-benzyl-p-(2-phenoxyethoxy)cumyl]salicylic acid,
5-[m-chloro-p-(2-phenoxyethoxy)cumyl]salicylic acid,
5-[m,m'-dimethyl-p-(2-phenoxyethoxy)cumyl]salicylic acid,
5-[m,m'-dichloro-p-(2-phenoxyethoxy)cumyl]salicylic acid,
5-[m-methyl-o-(2-phenoxyethoxy)cumyl]salicylic acid,
5-[m-tert-butyl-o-(2-phenoxyethoxy)cumyl]salicylic acid,
5-[o-methoxy-p-(2-phenoxyethoxy)cumyl]salicylic acid,
3-methyl-5-[p-(2-phenoxyethoxy)cumyl]salicylic acid,
3-cyclohexyl-5-[p-(2-phenoxyethoxy)cumyl]salicylic acid,
3-allyl-5-[p-(2-phenoxyethoxy)cumyl]salicylic acid,
3-α,α-dimethylbenzyl-5-[p-(2-phenoxyethoxy)cumyl]-salicylic acid,
3-phenyl-5-[p-(2-phenoxyethoxy)cumyl]salicylic acid,
3-chloro-5-[p-(2-phenoxyethoxy)cumyl]salicylic acid,
3-bromo-5-[p-(2-phenoxyethoxy)cumyl]salicylic acid,
3-methoxy-5-[p-(2-phenoxyethoxy)cumyl]salicylic acid,
5-methyl-3-[p-(2-phenoxyethoxy)cumyl]salicylic acid,
5-α-methylbenzyl-3-[p-(2-phenoxyethoxy)cumyl]salicylic acid.

Useful salicylic acid derivatives and/or polyvalent metal salts thereof are not limited to those described above. Further at least two of such compounds are usable in combination.

Among the salicylic acid derivatives of the formulae 1 and 2, particularly preferable is a derivative of the formula 3 below which provides a heat sensitive recording material which is excellent in the preservability of recorded images, especially in the preservability of halftone when exposed at high-humid atmosphere for a long period of time

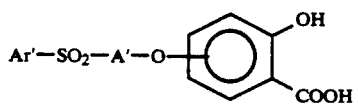

(3)

wherein Ar' is phenyl or phenyl substituted with $C_{1\sim4}$ alkyl, $C_{1\sim4}$ alkoxyl or chlorine atom, A' is $C_{2\sim6}$ alkylene.

According to the present invention, the specific compound of the formula 1 or 2 or the polyvalent metal salt thereof is used in an amount which is not limited specifically. However, the amount is adjustable over the range of 50 to 700 parts by weight, preferably about 100 to about 500 parts by weight, per 100 parts by weight of the color former to be used.

When a metal compound is incorporated into the heat sensitive recording layer along with the color developer, further improved characteristics can be given to the recording material to be obtained. The metal compound referred to is, for example, an oxide, hydroxide, sulfide, halide, carbonate, phosphate, silicate, sulfate, nitrate or a halogen complex salt of a metal selected from among bivalent, trivalent and tetravalent metals, such as zinc, magnesium, barium, calcium, aluminum, tin, titanium, nickel, cobalt, manganese and iron. Among these examples, zinc compounds are desirable. More specific examples of metal compounds are zinc oxide, zinc hydroxide, zinc aluminate, zinc sulfide, zinc carbonate, zinc phosphate, zinc silicate, aluminum oxide, magnesium oxide, titanium oxide, aluminum hydroxide, aluminum silicate, aluminum phosphate, magnesium aluminate, magnesium hydroxide, magnesium carbonate and magnesium phosphate. These metal compounds can be used as required in a mixture of at least two of them.

While these metal compounds are used in an amount which is of course not limited specifically, the amount is adjusted usually over the range of 1 to 500 parts by weight, preferably about 5 to about 300 parts by weight, per 100 parts by weight of the compound of the formula 1 or 2 or the polyvalent metal salt thereof.

The color developer may be used in combination with other known color developer. Examples of such developers are as follows.

Examples of useful inorganic acidic materials are activated clay, attapulgite, colloidal silica and aluminum silicate. Examples of organic acidic materials include 4-tert-butylphenol, 4-hydroxydiphenoxide, α-naphthol, β-naphthol, 4-hydroxyacetophenone, 4-tert-octylcatechol, 2,2'-dihydroxydiphenyl, 4,4'-isopropylidenebis(2-tert-butylphenol), 4,4'-sec-butylidenediphenol, 4-phenylphenol, 4,4'-isopropylidenediphenol (bisphenol A), 2,2-bis(4-hydroxyphenyl)-4-methylpentane, 2,2'-methylenebis(4-chlorophenol), hydroquinone, 4,4'-cyclohexylidenediphenol, 4,4'-(p-phenylenediisopropylidene)diphenol, 4,4'-(m-phenylenediisopropylidene)diphenol, 2-(4-hydroxyphenyl)-2-{4-[1,1-bis(4-hydroxyphenyl)ethyl]phenyl} propane, 1,5-bis(4-hydroxyphenylthio)-3-oxa-pentane, 1,7-bis(4-hydroxyphenylthio)-3,5-dioxa-heptane, 2-(4-hydroxyphenylthio)ethyl (4-hydroxyphenylthio)acetate, 1-[α-methyl-α-(4'-hydroxyphenyl)ethyl]-4-[α',α'-bis(4''-hydroxyphenyl)ethyl]benzene, 4,4'-dihydroxydiphenylsulfide, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin, phenolic polymer and like phenolic compounds; benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid and like aromatic carboxylic acids, 4,4'-dihydroxydiphenylsulfone, 4-hydroxy-4'-isopropyloxydiphenylsulfone, bis(3-allyl-4-hydroxyphenyl)sulfone, 4-hydroxy-4'-methyldiphenylsulfone, 2,4'-dihydroxydiphenylsulfone, 3,4-dihydroxydiphenylsulfone, 3,4-dihydroxy-4'-methyldiphenyl-sulfone and like 4-hydroxydiphenylsulfone derivatives, bis(3-tert-butyl-4-hydroxy-6-methylphenyl)sulfide, bis(2-methyl-4-hydroxy-6-tert-butylphenyl)sulfide and like sulfide derivatives; also, salts of such phenolic compounds or aromatic carboxylic acids with zinc, magnesium, aluminum, calcium, titanium, manganese, tin, nickel and like polyvalent metals; complex of antipyrine and zinc thiocyanate, etc.

Further, known various heat-fusible substances can be used as required. Examples of useful heat-fusible substances are caproic acid amide, capric acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide, polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(2-methylphenoxy)-2-(4-methoxyphenoxy)ethane, dibenzyl terephthalate, dibenzyl oxalate, di(4-methylbenzyl)oxalate, benzyl p-benzyloxybenzoate, p-benzylbiphenyl, 1,5-bis(p-methoxyphenoxy)-3-oxa-pentane, 1,4-bis(2-vinyloxyethoxy)benzene, p-biphenyl p-tolyl ether, benzyl p-methylthiophenyl ether, 2,2'-methylenebis(4-methyl-6-tert-butylphenol), 2,2'-methylenebis(4-ethyl-6-tert-butylphenol), 4,4'-butylidenebis(6-tert-butyl-3-methylphenol), 1,1,3-tris(2-methyl-4-hydroxy-5-tert-butylphenyl)butane, 1,1,3-tris(5-cyclohexyl-4-hydroxy-2-methylpheny)butane, benzotriazole, 1-N-hydroxybenzotriazole, 1-N-benzoyl-benzotriazole, 1-N-acetylbenzotriazole, 2-(2'-hydroxy-5'-methylphenyl)benzotriazole, 2-(2'-hydroxy-3',5'-di-tert-butylphenyl)-5-chloro-benzotriazole, 2-(2'-hydroxy-3'-tert-butyl-5'-methylphenyl)-5-chlorobenzotriazole, 2-(2'-hydroxy-3',5'-di-tert-amylphenyl)benzotriazole, 2-(2'-hydroxy-3',5'-di-tert-butylphenyl)benzotriazole, 2-(2'-hydroxy-5'-tert-butylphenyl)-benzotriazole, 2-(2'-hydroxy-5'-tert-octylphenyl)-benzotriazole and 2-[2'-hydroxy-3',5'-bis(α,α-dimethylbenzyl)phenyl]benzotriazole.

Although the amount of the heat-fusible substance to be used is not particularly limited, it is preferable to use in an amount of usually 50 to 700 parts by weight, preferably 100 to 500 parts by weight per 100 parts by weight of the color former.

In the present heat sensitive recording material, various known colorless or light-colored basic dyes can be used as a color former which is used in combination with the above specific color developer.

Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(4-dimethylaminophenyl)-3-(4-diethylamino-2-methylphenyl)-6-(dimethylamino)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl- 3-(1-methylpyrrole-3-yl)-6-dimethylaminophthalide, 3-(4-diethylamino-2-methylphenyl)-3-(1-ethyl-2-methylindole-3-yl)-4-azaphthalide, 3-(4-diethylamino-2-methylphenyl)-3-(1-octyl-2-methylindole-3-yl)-4-azaphthalide, 3,3-bis(4-diethylamino-2-ethoxyphenyl)-4-azaphthalide, 3,3-bis(4-diethylamino-2-methoxyphenyl)-4-azaphthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Divinylphthalide-based dyes, e.g., 3,3-bis[1,1-bis(4-pyrrolidinophenyl)ethylene-2-yl]-4,5,6,7-tetrabromophthalide, 3,3-bis[1-(4-methoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, etc.

Thiazine-based dyes, e.g., benzoyl-leucomethyleneblue, p-nitrobenzoyl-leucomethyleneblue, etc.

Spiro-based dyes, e.g., 3-methyl-spirodinaphthopyran, 3-ethyl-spiro-dinaphthopyran, 3-phenyl-spirodinaphthopyran, 3-benzyl-spiro-dinaphthopyran, 3-methylnaphtho(6'-methoxybenzo)spiropyran, 3-propyl-spirodibenzopyran, etc.

Lactam-based dyes, e.g., rhodamine-B-anilinolactam, rhodamine(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 4-benzylamino-8-diethylaminobenzo[a]fluoran, 3-[4-(4-dimethylaminoanilino)anilino]-7-chloro-6-methylfluoran, 8-[4-(4-dimethylaminoanilino)anilino]-benzo[a]fluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dimethylamino-6-methyl-7-phenylaminofluoran, 3-di-n-butylamino-6-methyl-7-phenylaminofluoran, 3-di-n-pentylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-di-n-butylamino-7-(o-chlorophenylamino)fluoran, 3-(N-ethyl-N-n-hexylamino)-7-(o-chlorophenylamino)fluoran, 3-(N-ethyl-N-isoamylamino)-7-(o-chlorophenylamino)fluoran, 3-(N-ethyl-N-tetrahydrofurfuryl-amino)-6-methyl-7-phenylaminofluoran, 3-(N-methyl-N-n-propylamino)-6-methyl-7-phenylaminofluoran, 3-(N-ethyl-N-isobutylamino)-6-methyl-7-phenylaminofluoran, 3-(N-methyl-N-n-hexylamino)-6-methyl-7-phenylaminofluoran, 3-[N-(3-ethoxypropyl)-N-methylamino]-6-methyl-7-phenylaminofluoran, 3-[N-ethyl-N-(3-ethoxypropyl)amino]-6-methyl-7-phenylaminofluoran, 3-diethylamino-7-[m-(trifluoromethyl)phenylamino]fluoran, 3-diethylamino-7-(o-fluorophenylamino)fluoran, 3-di-n-butylamino-7-(o-fluorophenylamino)fluoran, 3-diethylamino-6-chloro-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, 2,2-bis{4-[6'-(N-cyclohexyl-N-methylamino)-3'-methylspiro(phthalide-3,9'-xanthene)-2'-ylamino]phenyl}propane, etc.

Fluorene-based dyes, e.g., 3,6-bis(dimethylamino)-fluorene-9-spiro-3'-(6'-dimethylamino)phthalide, 3-diethylamino-6-(N-allyl-N-methylamino)fluorene-9-spiro-3'-(6'-dimethylamino)phthalide, 3,6-bis(dimethylamino)-spiro-[fluorene-9,6'-6'H-chromeno(4,3-b)indole], 3,6-bis(dimethylamino)-3'-methyl-spiro[fluorene-9,6'-6'H-chromeno(4,3-b)indole], 3,6-bis(diethylamino)-3'-methyl-spiro[fluorene-9,6'-6'H-chromeno(4,3-b)indole], etc.

These basic dyes are not limited to thereabove and can be used as required in a mixture of at least two of them.

Among the above color formers, more preferable is a fluoran-based dye of the formula 4 below which provides recorded images having deep black color when employed in combination with the color developer used in the present invention

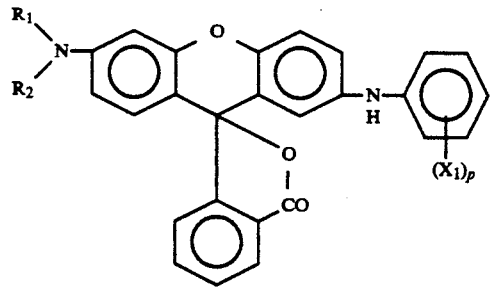

(4)

wherein $R_1$ and $R_2$ are each $C_{1\sim6}$ alkyl, $C_{3\sim6}$ alkoxyalkyl, cyclopentyl, cyclohexyl, tetrahydrofurfuryl or p-tolyl, $R_1$ and $R_2$ may form pyrrolidine ring or piperidine ring together with an adjacent nitrogen atom, X, is chlorine atom, fluorine atom or trifluoromethyl, p is 1 or 2.

For preparing a coating composition comprising the foregoing components, the color former, the color developer and the heat-fusible substance sucn as a sensitizer are dispersed, together or individually, into water serving as a dispersion medium, using stirring and pulverizing means such as a ball mill, attritor, vertical or horizontal sand mill, colloid mill or the like.

Usually the coating composition has incorporated therein a binder in an amount of 10 to 40 % by weight, preferably 15 to 30 % by weight, based on the total solids content of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc.

Various other auxiliary agents can be further added to the coating composition. Examples of useful agents are dispersants such as sodium dioctylsulfosuccinate, sodium dodecylbenzenesulfonate, sodium salt of lauryl alcoholsulfuric acid ester, fatty acid metal salts, etc., ultraviolet absorbers such as benzophenone compound, cyanoacrylate compounds and hydroxybenzoate compounds, defoaming agents, fluorescent dyes, coloring dyes, etc.

To the coating composition is added as required a dispersion or emulsion of stearic acid ester wax, polyethylene wax, carnauba wax, microcrystalline wax, carboxyl-modified paraffin wax, zinc stearate, calcium stearate or the like.

Also to the coating composition is added as required an inorganic pigment such as kaolin, clay, talc, calcium carbonate, magnesium carbonate, calcined clay, titanium oxide, kieselguhr, fine particulate anhydrous silica and activated clay, or an organic pigment such as styrene microballs, nylon powder, polyethylene powder, urea-formalin resin filler and particulate raw starch.

Examples of substrates useful for the heat sensitive recording materials of the present invention are paper, plastics film, synthetic paper, sheet formed by non-woven fabric, etc. Among these, plastics film or synthetic paper provides a recording material which is excellent in gradiation recording properties. The plastics film or synthetic paper includes sheet obtained by affixing a plastics film or synthetic paper to coated paper, wood-free paper or the like with an adhesive, and also a sheet prepared by laminating plastics to paper.

Examples of useful plastics films are those of polyethylene, polypropylene, polyester, polyvinyl chloride, polystyrene, nylon, etc. Examples of useful synthetic papers are those prepared by a film process or fiber process. Film processes include an internal paper making process wherein a synthetic resin, filler and additives are kneaded in a molten state and thereafter extruded into a film, surface coating process wherein a pigment-coated layer is formed, and surface treating process. The synthetic papers prepared by the fiber process include synthetic pulp paper and spun bonded paper. Among these substrates, plastic films and synthetic papers prepared by the film processes are most desirable to use since such substrates give more excellent recording characteristics. An undercoat layer can of course be formed between the substrate and the recording layer.

The method of forming the recording layer is not limited specifically, but conventional well-known techniques are usable. For example, the coating composition is applied to the substrate by bar coating, air knife coating, rod blade coating, pure blade coating or short dwell coating, followed by drying. When the plastics film is used as the substrate, the surface thereof can be treated by corona discharge or irradiation with electron rays. This achieves an improved coating efficiency. Although the amount of coating composition to be applied is not limited specifically, it is usually 2 to 12 $g/m^2$, preferably about 3 to about 10 $g/m^2$ by dry weight.

To prepare the heat sensitive recording material of the present invention, an intermediate layer is first formed over the heat sensitive recording layer thus obtained. Examples of water-soluble resins or water-dispersible resins useful for forming the intermediate layer are as follows.

Completely saponified or partially saponified polyvinyl alcohol, acetoacetylated polyvinyl alcohol having an acetoacetyl group introduced therein by reacting polyvinyl alcohol with a diketene, a reaction product of polyvinyl alcohol and a polycarboxylic acid such as fumaric acid, phthalic anhydride, trimellitic anhydride or itaconic anhydride or an ester of the product, carboxyl-modified polyvinyl alcohol prepared from a copolymer of vinyl acetate and an ethylenically unsaturated carboxylic acid such as maleic acid, fumaric acid, itaconic acid, crotonic acid, acrylic acid or methacrylic acid by saponifying the copolymer, a sulfonic acid-modified polyvinyl alcohol prepared from a copolymer of vinyl acetate and ethylenesulfonic acid, allylsulfonic acid or like olefinic sulfonic acid or a salt thereof by saponifying the copolymer, olefin-modified polyvinyl alcohol prepared from acopolymer of vinyl acetate and an olefin such as ethylene, propylene, isobutylene, α-octene, α-dodecene or α-octadodecene by saponifying the copolymer, nitrile-modified polyvinyl alcohol prepared from a copolymer of vinyl acetate and a nitrile such as acrylonitrile or methacrylonitrile by saponifying the copolymer, amide-modified polyvinyl alcohol prepared from a copolymer of vinyl acetate and an amide such as acrylamide or methacrylamide by saponifying the copolymer, pyrrolidone-modified polyvinyl alcohol prepared by saponifying the copolymer of vinyl acetate and N-vinylpyrrolidone, methylcellulose, ethylcellulose, hydroxyethylcellulose, carboxymethylcellulose and like cellulose derivatives, casein, gum grabic, oxidized starch, etherified starch, dialdehyde starch, esterified starch and like starches, styrene-butadiene copolymer emulsion, vinyl acetate-vinyl chloride-ethylene copolymer emulsion, methacrylate-butadiene copolymer emulsion, etc.

Among these water-soluble or water-dispersible resins, modified polyvinyl alcohols, cellulose derivatives and casein are preferable. Especially, acetoacetylated polyvinyl alcohol and carboxyl-modified polyvinyl alcohol are more preferable.

To give a leveled surface to the intermediate layer, pigments can be incorporated into the layer. Examples of useful pigments are inorganic pigments such as calcium carbonate, zinc oxide, aluminum oxide, titanium dioxide, silicon dioxide, aluminum hydroxide, barium sulfate, zinc sulfate, talc, kaolin, clay, calcined clay and colloidal silica, and organic pigments such as styrene microballs, nylon powder, polyethylene powder, urea-formaline resin filler and raw starch. The pigment is used generally in an amount of 5 to 500 parts by weight, preferably about 80 to about 350 parts by weight, per 100 parts by weight of the resin component.

When required, the coating composition for forming the intermediate layer may have admixed therewith a curing agent such as glyoxal, methylolmelamine, potassium persulfate, ammonium persulfate, sodium persulfate, ferric chloride, magnesium chloride, boric acid or ammonium chloride. The additives which can be incorporated into the composition when so desired include lubricants such as zinc stearate, calcium stearate, stearamide, polyethylene wax, carnauba wax, paraffin wax and ester wax, surfactants such as sodium dioctylsulfosuccinate, sodium dodecylbenzenesulfonate, sodium salt of lauryl alcohol-sulfuric acid ester, alginate and fatty acid metal salt, ultraviolet absorbers such as benzophenone and triazole compounds, defoaming agents, fluorescent dyes, coloring dyes and like auxiliary agents.

The coating composition for forming the intermediate layer is prepared generally as an aqueous composition. When required, the ingredients are fully mixed together into a dispersion by a mixer, attritor, ball mill, roll mill or like mixing or agitating device. The composition is then applied to the recording layer by one of known coating devices. The coating formed can be cured and dried by irradiation with ultraviolet rays or electron rays.

The curing agent, when to be used, can be incorporated into the coating composition for the intermediate layer, or can be applied separately from the intermediate layer forming composition. The separate application of the agent has the advantage that a powerful curing agent can be selected for use without considering the possible adverse effect on the pot life of the coating composition.

When required, the same coating layer as above can be formed also on the rear surface of the recording material to give further improved preservability. Furthermore, an adhesive can be applied to the rear surface of the recording material to provide adhesive labels. Thus, various techniques known in the art of preparing heat sensitive recording materials can be additionally restorted to as required.

The amount of coating composition to be applied for forming the intermediate layer is not limited specifically, whereas if the amount is less than 0.1 $g/m^2$, the desired effect of the invention can not be achieved, while amounts exceeding 20 $g/m^2$ are likely to seriously reduce the recording sensitivity of the material. Accordingly, the amount is adjusted generally to 0.1 to 20 $g/m^2$, preferably about 0.5 to about 10 $g/m^2$, by dry weight.

An overcoat layer containing a resin which is curable with an ionizing radiation is formed over the intermediate layer thus prepared. The recording material can be given a higher record density and enhanced gloss by making the intermediate layer more smooth-surfaced, so that the layer is treated as by supercalendering. Generally in the case where the substrate is a film or synthetic paper, the layer is adjusted to a higher degree of surface smoothness than when it is common paper. The surface of the intermediate layer is adjusted to at least 50 seconds, preferably to at least 300 seconds, more preferably to at least 3000 seconds, in Bekk smoothness.

Examples of resins which are curable with an ionizing radiation and useful for forming the overcoat layer are the following prepolymers and monomers.

Prepolymers a) Poly(meth)acrylates of aliphatic, alicyclic, aroma-aliphatic or aromatic dihydric to hexahydric alcohols and polyalkylene glycols.
b) Poly(meth)acrylates of polyhydric alcohols which are adducts of an aliphatic, alicyclic, aroma-aliphatic or aromatic dihydric to hexavalent alcohol with an alkylene oxide.
c) Poly(meth)acryloyloxyalkylphosphoric acid esters.
d) Polyester poly(meth)acrylates.
e) Epoxy poly(meth)acrylates.
f) Polyurethane poly(meth)acrylates.
g) Polyamide poly(meth)acrylates.
h) Polysiloxane poly(meth)acrylates.
i) Vinyl or diene low polymers having a (meth)acryloyloxy group on the side chain and/or terminal end.
j) Oligoester (meth)acrylates as modified and corresponding to the prepolymers a) to i).

Monomers a) Carboxyl-containing monomers typical of which are ethylenically unsaturated mono- or poly-carboxylic acids, and monomers containing a carboxylic acid base, such as alkali metal salts, ammonium salts and amine salts of these monomers.
b) Amide group-containing monomers typical of which are ethylenically unsaturated (meth)acrylamide or alkyl-substituted (meth)acrylamide, N-vinylpyrrolidone and like vinyllactams.
c) Monomers containing a sulfonic group, such as aliphatic or aromatic vinylsulfonic acids, and monomers containing a sulfonic acid base, such as alkali metal salts, ammonium salts and amine salts of these monomers.
d) Hydroxyl-containing monomers typical of which are ethylenically unsaturated ethers.
e) Amino-containing monomers such as dimethylaminoethyl (meth)acrylate-2-vinylpyridine.
f) Monomers containing a quaternary ammonium salt.
g) Alkyl esters of ethylenically unsaturated carboxylic acids.
h) Nitrile-containing monomers such as (meth)acrylonitrile.
i) Styrene.
j) Esters of ethylenically unsaturated alcohols, such as vinyl acetate and (meth)allyl acetate.
k) Mono(meth)acrylates of alkylene oxide-adducted polymers of compounds containing active hydrogen.
l) Ester-containing bifunctional monomers typical of which are diesters of a polybasic acid and an unsaturated alcohols.
m) Bifunctional monomers comprising a diester of (meth)acrylic acid and an alkylene oxide-adducted polymer of active hydrogen-containing compound.
n) Bisacrylamides such as N,N-methylenebisacrylamide.
o) Bifunctional monomers such as divinylbenzene, divinyl ethylene glycol, divinylsulfone; divinyl ether and divinyl ketone.
p) Ester-containing polyfunctional monomers typical of which are polyesters of a polycarboxylic acid and an unsaturated alcohol.
q) Polyfunctional monomers comprising a polyesters of (meth)acrylic acid and an alkylene oxide-adducted polymer of active hydrogen-containing compound.
r) Polyfunctional unsaturated polymers such as trivinylbenzene.

Especially preferable are ionizing radiation-curable resins which are at least 150° C. in glass transition temperature when cured because these resin are very effective for preventing the recording material from sticking to the recording head during high-speed recording. Examples of such resins are pentaerythritol triacrylate, trimethylolpropane triacrylate, dipentaerythritol hexaacrylate, tris(acryloxyethyl) isocyanurate and like polyfunctional monomers, polysiloxane polyacrylates, tetra- to poly-functional oligoester acrylates.

According to the present invention, pigments can be incorporated into the layer of ionizing radiation-curable resin when required. Examples of useful pigments are inorganic pigments such as calcium carbonate, barium carbonate, zinc carbonate, zinc oxide, aluminum oxide, titanium dioxide, silicon dioxide, aluminum hydroxide, barium sulfate, zinc sulfate, talc, kaolin, clay, calcined clay and colloidal silica, pigments prepared by surface-treating such inorganic pigments with an organic acid, and organic pigments such as styrene microballs, nylon powder, polyethylene powder, ureaformalin resin powder, cellulose acetate powder, polymethyl methacrylate powder, fluorocarbon resin powder, epoxy resin powder, benzoguanamine resin powder and raw starch.

If the pigment has an excessively large mean particle size, the images recorded on the resulting material will be of impaired quality although the pigment is efffective for giving improved resistance to sticking. Accordingly, it is desirable that the pigment to be used have a mean particle size of up to 15 μm, preferably up to 5 μm.

The pigment is mixed with and dispersed in the ionizing radiation-curable resin usually by a high-speed mixer or like suitable mixing or agitating device. The advantage of the present invention can be assured more effectively if the pigment is dispersed in the form of primary particles in the resin using a device for giving a high shearing force, such as a kneader or roll mill. In addition to the prepolymer or monomer, and pigments, resins other than those curable with ionizing radiation and additives can be suitably admixed with the resin component of the overcoat composition when so required. Examples of useful additives are defoaming agent, leveling agent, lubricant, surfactant, plasticizer, ultraviolet absorber, fluorescent dye, coloring dye, fluorecent pigment and coloring pigment.

The heat sensitive recording material can be given surface properties widely varying from a matted appearance to a high gloss by using different additives and adjusting the proportions thereof. Examples of useful resins other than those curable with ionizing radiation are acrylic resin, silicone resin, alkyd resin, fluorocarbon resin, butyral resin, etc.

The above ingredients of the resin component are fully mixed together by a mixer or like suitable mixing or agitating device and thereafter applied onto the intermediate layer. When required, the resin component can be heated for viscosity adjustment. The amount of resin component to be used is not always limited, whereas if it is less than 0.1 g/m$^2$, the desired effect of the invention will not be achieved, while amounts in excess of 20 g/m$^2$ are likely to give lower recording sensitivity. Accordingly, it is desirable to adjust the amount to 0.1 to 20 g/m$^2$, more desirably to about 0.3 to about 10 g/m$^2$.

Examples of ionizing radiations for curing the resin are electron rays, ultraviolet rays, alpha rays, beta rays, gamma rays, X-rays, etc. Electron rays and ultraviolet rays, which are easy to handle and widely used in industries, are preferable to use since alpha rays, beta rays, gamma rays and X-rays have the problem of being hazardous to-the human body.

When the resin layer formed over the intermediate layer is to be cured by irradiation with electron rays, the dose of electron rays to be applied is 0.1 to 15 Mrad, preferably about 0.5 to about 10 Mrad. Insufficient irradiation fails to fully cure the resin component, while excessive irradiation with electron rays is likely to permit color formation or discoloration of the recording material.

Electron rays can be applied, for example, by a scanning method, curtain beam method or broad beam method. The acceleration voltage for the application is suitably about 100 to about 300 KV. The application of electron rays has the advantage of achieving high productivity and being free of the problem of odor or discoloration due to the use of a sensitizer unlike the application of ultraviolet rays.

When ultaviolet rays are to be used, there is a need to admix a sensitizer with the coating composition. Examples of suitable sensitizers are thioxanthone, benzoin, benzoin alkylether xanthone, dimethylxanthone, benzophenone, anthracene, 2,2-diethoxyacetophenone, benzyl dimethyl ketal, benzyldiphenyl disulfide, anthraquinone, 1-chloroanthraquinone, 2-ethylanthraquinone, 2-tert-butylanthraquinone, N,N'-tetraethyl-4,4'-diaminobenzophenone, 1,1-dichloroacetophenone and the like. At least one of these sensitizers is used.

The amount of sensitizer to be used is adjusted preferably to 0.2 to 10 wt. %, more preferably about 0.5 to about 5 wt. %, based on the ionizing radiation-curable monomer and/or oligomer or prepolymer present in the coating composition. To assure accelerated curing, the sensitizer can be used in combination with a tertiary amine such as triethanolamine, 2-dimethyl-aminoethanol, dimethylaminobenzoic acid, isoamyl dimethylaminobenzoate, dioctylaminobenzoic acid or lauryl dimethylaminobenzoate. The amine is used in an amount of about 0.05 to about 3 wt. % based on the ionizing radiation-curable monomer and/or oligomer or prepolymer present in the coating composition.

Examples of useful light sources for ultraviolet irradiation are 1 to 50 ultraviolet lamps (e.g., low-pressure, medium-pressure or high pressure mercury lamps having an operating pressure of several mm Hg to about 10 atom.), xenone lamps, tungsten lamps, etc., whereby ultraviolet rays are applied at an intensity of about 5,000 to about 8,000 μW/cm.

The recording material formed with the overcoat layer can be treated as by supercalendering to further diminish variations in record density.

The present invention will be described in greater detail with reference to the following examples, which nevertheless in no way limit the invention. The parts and percentages in these examples are all by weight unless otherwise specified.

EXAMPLE 1

Preparation of Composition A

| | |
|---|---|
| 3-Di-n-butylamino-7-(o-chlorophenylamino)-fluoran | 10 parts |
| 1,2-Di(3-methylphenoxy)ethane | 20 parts |
| 5% Aqueous solution of methylcellulose | 20 parts |
| Water | 50 parts |

The above composition was pulverized to a mean particle size of 2 μm by a sand mill.

Preparation of Composition B

| | |
|---|---|
| Zinc salt of 4-(3-p-tolylsulfonylpropyloxy)-salicylic acid | 20 parts |
| 5% Aqueous solution of methylcellulose | 30 parts |
| Water | 50 parts |

The above composition was pulverized to a mean particle size of 2 μm by a sand mill.

Formation of Recording Layer

Composition A (100 parts), 100 parts of Composition B, 10 parts of silicon dioxide pigment (oil absorption 180 ml/100 g), 75 parts of 20% aqueous solution of oxidized starch and 75 parts of 20% aqueous solution of polyvinyl alcohol were mixed together with stirring to prepare a recording layer coating composition. The resulting composition was applied to synthetic paper having thickness of 80 μm (brand name: Yupo FPG, product of Oji-Yuka Synthetic Paper Co., Ltd.) to a dry weight of 6.0 g/m², followed by drying and supercalendering to obtain a heat sensitive recording material.

Formation of Intermediate Layer

The recording layer of the head sensitive recording material was coated with a composition composed of the following ingredients in an amount of 4.0 g/m² when the coating was dried. The coating was dried and supercalendered to prepare a heat sensitive recording material having an intermediate layer which was 5,000 seconds in Bekk smoothness.

| | |
|---|---|
| 8% Aqueous solution of polyvinyl alcohol | 1,000 parts |
| Calcium carbonate | 100 parts |
| Water | 100 parts |

Formation of Overcoat Layer

The intermediate layer was coated with a mixture of 100 parts of oligoester acrylate (at least 250° C. in Tg when cured, brand name: M-8030, product of Toagosei Chemical Industry Co., Ltd.) and 15 parts of calcium carbonate, 0.2 μm in mean particle size, in an amount of 4.0 g/m² by dry weight. The coating was treated by an electron curtain beam irradiator (Model CB: 150, product of ESI Corporation) at a dose of 3 Mrad to cure the resin component and obtain a heat sensitive recording material having an overcoat layer.

EXAMPLE 2

A heat sensitive recording material was prepared in the same manner as in Example 1 except that the zinc salt of 4-(3-p-methoxyphenylsulfonylpropyloxy)xalicylic acid was used in place of the zinc salt of 4-(3-p-tolylsulfonylpropyloxy)salicylic acid for preparing Composition B of Example 1.

EXAMPLE 3

A heat sensitive recording material was prepared in the same manner as in Example 1 except that the zinc salt of 4-(2-p-phenoxyethoxy)salicylic acid was used in place of the zinc salt of 4-(3-p-tolylsulfonylpropyloxy)salicylic acid for preparing Composition B of Example 1.

EXAMPLE 4

A heat sensitive recording material was prepared in the same manner as in Example 1 except that the zinc salt of 4-(2-p-methoxyphenoxyethoxy)salicylic acid was used in place of the zinc salt of 4-(3-p-tolylsulfonylpropyloxy)salicylic acid for preparing Composition B of Example 1.

EXAMPLE 5

A heat sensitive recording material was prepared in the same manner as in Example 1 except that the zinc salt of 5-[p-(2-p-methoxyphenoxyethoxy)cumyl]salicylic acid was used in place of the zinc salt of 4-(3-p-tolylsulfonylpropyloxy)salicylic acid for preparing Composition B of Example 1.

EXAMPLE 6

A heat sensitive recording material was prepared in the same manner as in Example 1 except that the zinc salt of 5-[p-(3-p-phenylsulfonylpropyloxy)cumyl]salicylic acid was used in place of the zinc salt of 4-(3-p-tolylsulfonylpropyloxy)salicylic acid for preparing Composition B of Example 1.

EXAMPLE 7

A heat sensitive recording material was prepared in the same manner as in Example 1 with the exception of using 20 parts of 4-(3-p-tolylsulfonylpropyloxy)salicylic acid and 10 parts of zinc oxide in place of the zinc salt of 4-(3-p-tolylsulfonylpropyloxy)salicylic acid and using 40 parts of water in place of 50 parts thereof for preparing Composition B of Example 1.

EXAMPLE 8

A heat sensitive recording material was prepared in the same manner as in Example 7 except that 20 parts of 4-(2-p-methoxyphenoxyethoxy)salicylic acid was used in place of 20 parts of 4-(3-p-tolylsulfonylpropyloxy)salicylic acid for preparing Composition B of Example 7.

EXAMPLE 9

A heat sensitive recording material was prepared in the same manner as in Example 7 except that 20 parts of 5-[p-(2-p-methoxyphenoxyethoxy)cumyl]salicylic acid was used in place of 20 parts of 4-(3-p-tolylsulfonylpropyloxy)salicylic acid for preparing Composition B of Example 7.

EXAMPLE 10

A heat sensitive recording material was prepared in the same manner as in Example 1 except that 10 parts of 3-di-n-butylamino-6-methyl-7-phenylaminofluoran was used in place of 10 parts of 3-di-n-butylamino-7-(o-chlorophenylamino)fluoran for preparing Composition A of Example 1.

EXAMPLE 11

A heat sensitive recording material was prepared in the same manner as in Example 1 except that 10 parts of 3-(N-ethyl-N-isoamylamino)-7-(o-chlorophenylamino)-fluoran was used in place of 10 parts of 3-di-n-butylamino-7-(o-chlorophenylamino)fluoran for preparing Composition A of Example 1.

EXAMPLE 12

A heat sensitive recording material was prepared in the same manner as in Example 1 except that 10 parts of 3-(N-ethyl-N-n-hexylamino)-7-(o-chlorophenylamino)-fluoran was used in place of 10 parts of 3-di-n-butylamino-7-(o-chlorophenylamino)fluoran for preparing Composition A of Example 1.

EXAMPLE 13

A heat sensitive recording material was prepared in the same manner as in Example 11 with the exception of using 20 parts of zinc salt of 5-(3-p-tolylsulfonylpropyloxy)salicylic acid in place of 20 parts of the zinc salt of 4-(3-p-tolylsulfonylpropyloxy)salicylic acid.

EXAMPLE 14

Preparation of Composition C

| | |
|---|---|
| 1-[α-Methyl-α-(4'-hydroxyphenyl)ethyl]-4-[α',α'-bis(4''-hydroxyphenyl)ethyl]benzene | 20 parts |
| 5% Aqueous solution of methylcellulose | 30 parts |
| Water | 50 parts |

The above composition was pulverized to a mean particle size of 2 μm by a sand mill.

Formation of Recording Layer

A heat sensitive recording material was prepared in the same manner as in Example 11 with the exception of using 50 parts of Composition B and 50 parts of the above Composition C in place of 100 parts of Composition B.

EXAMPLE 15

A heat sensitive recording material was prepared in the same manner as in Example 14 with the exception of using 20 parts of 4,4'-(m-phenylenediisopropylidene)diphenol in place of 20 parts of 1-[α-methyl-α-(4'-hydroxyphenyl)ethyl]-4-[α',α'-bis(4''-hydroxyphenyl)ethyl]-benzene in the preparation of Composition C.

EXAMPLE 16

A heat sensitive recording material was prepared in the same manner as in Example 1 except that 9.5 parts of 3-di-n-buthylamino-7-(o-chlorophenylamino)fluoran and 0.5 part of 3,3-bis(p-dimethylaminophenyl)-6-dimethylaminophthalide were used in place of 10 parts of 3-di-n-butylamino-7-(o-chlorophenylamino)fluoran for preparing Composition A of Example 1.

EXAMPLE 17

A heat sensitive recording material was prepared in the same manner as in Example 1 except that 9.5 parts of 3-di-n-butylamino-7-(o-chlorophenylamino)fluoran and 0.5 part of 3-(4-dimethylaminophenyl)-3-(4-diethylamino-2-methylphenyl)-6-(dimethylamino)phthalide were used in place of 10 parts of 3-di-n-butylamino-7-(o-chlorophenylamino)fluoran for preparing Composition A of Example 1.

EXAMPLE 18

A heat sensitive recording material was prepared in the same manner as in Example 11 except that 10 parts of 3-(N-ethyl-N-isoamylamino)-7-(o-chlorophenylamino)fluoran and 0.1 part of 3-(4-diethylamino-2-methylphenyl)-3-(1-ethyl-2-methylindole-3-yl)-4-azaphthalide were used in place of 10 parts of 3-(N-ethyl-N-isoamylamino)-7-(o-chlorophenylamino)fluoran for preparing Composition A of Example 11.

EXAMPLE 19

A heat sensitive recording material was prepared in the same manner as in Example 18 except that 0.1 part of 3,3-bis(4-diethylamino-2-ethoxyphenyl)-4-azaphthalide was used in place of 0.1 part of 3-(4-diethylamino-2-methylphenyl)-3-(1-ethyl-2-methylindole-3-yl)-4-azaphthalide for preparing Composition A of Example 18.

EXAMPLE 20

A heat sensitive recording material was prepared in the same manner as in Example 1 except that paper having thickness of 80 μm was used in place of the synthetic paper weighting 80 g/m$^2$ (brand name: Yupo FPG, product of Oji-Yuka Synthetic Paper Co., Ltd.) for forming the recording layer of Example 1.

EXAMPLE 21

A heat sensitive recording material was prepared in the same manner as in Example 4 except that paper having thickness of 80 μm was used in place of the synthetic paper weighting 80 g/m$^2$ (brand name: Yupo FPG, product of Oji-Yuka Synthetic Paper Co., Ltd.) for forming the recording layer of Example 4.

EXAMPLE 22

A heat sensitive recording material was prepared in the same manner as in Example 1 except that 100 parts of dipentaerythritol hexaacrylate (at least 250° C. in Tg when cured) was used in place of 100 parts of oligoester acrylate for forming the overcoat layer of Example 1.

EXAMPLE 23

A heat sensitive recording material was prepared in the same manner as in Example 1 except that 100 parts of pentaerythritol triacrylate (at least 250° C. in Tg when cured) was used in place of 100 parts of oligoester acrylate for forming the overcoat layer of Example 1.

COMPARATIVE EXAMPLE 1

A heat sensitive recording material was prepared in the same manner as in Example 1 except that 4,4'-isopropylidenediphenol was used in place of the zinc salt of 4-(3-p-tolylsulfonylpropyloxy)salicylic acid for preparing Composition B of Example 1.

COMPARATIVE EXAMPLE 2

A heat sensitive recording material was prepared in the same manner as in Example 1 except that 4-hydroxy-4'-isopropyloxydiphenylsulfone was used in place of the zinc salt of 4-(3-p-tolylsulfonylpropyloxy)-salicylic acid for preparing Composition B of Example 1.

COMPARATIVE EXAMPLE 3

A heat sensitive recording material was prepared in the same manner as in Example 1 except that the zinc salt of 3,5-di(α-methylbenzyl)salicylic acid was used in place of the zinc salt of 4-(3-p-tolylsulfonylpropyloxy)-salicylic acid for preparing Composition B of Example 1.

COMPARATIVE EXAMPLE 4

A heat sensitive recording material was prepared in the same manner as in Example 1 except that zinc salt of 3,5-dinonyloxysalicylic acid was used in place of the zinc salt of 4-(3-p-tolylsulfonylpropyloxy)salicylic acid for preparing Composition B of Example 1.

COMPARATIVE EXAMPLE 5

A heat sensitive recording material was prepared in the same manner as in Example 20 except that 4,4'-isopropylidenediphenol was used in place of the zinc salt of 4-(3-p-tolylsulfonylpropyloxy)salicylic acid for preparing Composition B of Example 20.

COMPARATIVE EXAMPLE 6

A heat sensitive recording material was prepared in the same manner as in Example 1 with the exception of not forming the overcoat layer.

Images were recorded on the heat sensitive recording materials thus obtained with a pulse width of 0.8, 1.0, 1.2 or 1.6 msec (millisecond) using a thermal recording tester (Ohkura Simulator, printing voltage 24 V, pulse period 2.0 msec). The heat sensitive recording materials after recording were checked for the color density of images and the fog of the background area by a Macbeth densitometer (Model RD-100R, manufactured by Macbeth Corp.). Table 1 shows the results.

The heat sensitive recording materials after recording were allowed to stand under a high-temperature humid condition at 40° C. and 90% RH for 24 hours and thereafter checked for the color density of the recorded images and background area again by the Macbeth densitometer. Table 2 also shows the results.

Further, the heat sensitive recording materials after recording were allowed to place in a high-humid condition at 20° C. and 90% RH for 7 days. Then the heat sensitive recording materials were checked for the color density of the recorded images and background are again by the Macbeth densitometer. Table 3 shows the results.

TABLE 1

| | Color Density before Treatment | | | | |
|---|---|---|---|---|---|
| | Fog in background area | Record image Recording pulse width (msec) | | | |
| | | 0.8 | 1.0 | 1.2 | 1.6 |
| Ex. 1 | 0.07 | 0.38 | 0.73 | 1.23 | 1.81 |
| Ex. 2 | 0.06 | 0.37 | 0.72 | 1.21 | 1.80 |
| Ex. 3 | 0.06 | 0.37 | 0.73 | 1.22 | 1.80 |
| Ex. 4 | 0.07 | 0.38 | 0.74 | 1.23 | 1.80 |
| Ex. 5 | 0.05 | 0.37 | 0.72 | 1.21 | 1.79 |
| Ex. 6 | 0.07 | 0.37 | 0.72 | 1.21 | 1.78 |
| Ex. 7 | 0.07 | 0.39 | 0.75 | 1.24 | 1.81 |
| Ex. 8 | 0.06 | 0.37 | 0.75 | 1.23 | 1.80 |
| Ex. 9 | 0.05 | 0.36 | 0.70 | 1.20 | 1.77 |
| Ex. 10 | 0.07 | 0.39 | 0.77 | 1.28 | 1.80 |
| Ex. 11 | 0.07 | 0.39 | 0.78 | 1.28 | 1.81 |
| Ex. 12 | 0.08 | 0.39 | 0.79 | 1.30 | 1.82 |
| Ex. 13 | 0.08 | 0.38 | 0.77 | 1.25 | 1.80 |
| Ex. 14 | 0.07 | 0.39 | 0.79 | 1.32 | 1.85 |
| Ex. 15 | 0.08 | 0.41 | 0.80 | 1.30 | 1.84 |
| Ex. 16 | 0.07 | 0.35 | 0.75 | 1.25 | 1.78 |
| Ex. 17 | 0.07 | 0.34 | 0.73 | 1.23 | 1.76 |
| Ex. 18 | 0.07 | 0.39 | 0.77 | 1.28 | 1.81 |
| Ex. 19 | 0.08 | 0.40 | 0.78 | 1.28 | 1.81 |
| Ex. 20 | 0.07 | 0.31 | 0.65 | 1.16 | 1.75 |
| Ex. 21 | 0.07 | 0.28 | 0.63 | 1.12 | 1.70 |
| Ex. 22 | 0.07 | 0.38 | 0.72 | 1.22 | 1.80 |
| Ex. 23 | 0.07 | 0.38 | 0.73 | 1.23 | 1.80 |
| Com. Ex. 1 | 0.10 | 0.35 | 0.72 | 1.21 | 1.80 |
| Com. Ex. 2 | 0.09 | 0.33 | 0.71 | 1.22 | 1.75 |
| Com. Ex. 3 | 0.15 | 0.37 | 0.68 | 1.15 | 1.68 |
| Com. Ex. 4 | 0.13 | 0.34 | 0.65 | 1.12 | 1.66 |
| Com. Ex. 5 | 0.10 | 0.28 | 0.61 | 1.12 | 1.71 |
| Com. Ex. 6 | 0.07 | 0.35 | 0.64 | 1.13 | 1.60 |

TABLE 2

| | Color Density after Treatment at 40° C., 90% RH for 24 hrs. | | | | |
|---|---|---|---|---|---|
| | Fog in background area | Record image Recording pulse width (msec) | | | |
| | | 0.8 | 1.0 | 1.2 | 1.6 |
| Ex. 1 | 0.09 | 0.38 | 0.75 | 1.25 | 1.82 |
| Ex. 2 | 0.08 | 0.37 | 0.73 | 1.23 | 1.81 |
| Ex. 3 | 0.08 | 0.38 | 0.75 | 1.24 | 1.81 |
| Ex. 4 | 0.09 | 0.38 | 0.76 | 1.25 | 1.81 |
| Ex. 5 | 0.06 | 0.38 | 0.74 | 1.23 | 1.80 |
| Ex. 6 | 0.09 | 0.39 | 0.74 | 1.22 | 1.78 |
| Ex. 7 | 0.09 | 0.40 | 0.76 | 1.26 | 1.81 |
| Ex. 8 | 0.08 | 0.38 | 0.76 | 1.24 | 1.80 |
| Ex. 9 | 0.07 | 0.38 | 0.71 | 1.22 | 1.78 |
| Ex. 10 | 0.09 | 0.40 | 0.80 | 1.31 | 1.80 |
| Ex. 11 | 0.10 | 0.39 | 0.81 | 1.31 | 1.82 |
| Ex. 12 | 0.13 | 0.43 | 0.83 | 1.33 | 1.85 |
| Ex. 13 | 0.10 | 0.40 | 0.80 | 1.27 | 1.81 |
| Ex. 14 | 0.09 | 0.39 | 0.80 | 1.32 | 1.84 |
| Ex. 15 | 0.11 | 0.38 | 0.78 | 1.30 | 1.82 |
| Ex. 16 | 0.10 | 0.38 | 0.77 | 1.26 | 1.80 |
| Ex. 17 | 0.09 | 0.37 | 0.75 | 1.24 | 1.78 |
| Ex. 18 | 0.10 | 0.39 | 0.79 | 1.31 | 1.81 |
| Ex. 19 | 0.11 | 0.41 | 0.79 | 1.30 | 1.80 |
| Ex. 20 | 0.09 | 0.31 | 0.67 | 1.18 | 1.78 |
| Ex. 21 | 0.09 | 0.26 | 0.61 | 1.10 | 1.75 |
| Ex. 22 | 0.09 | 0.39 | 0.75 | 1.24 | 1.81 |
| Ex. 23 | 0.09 | 0.39 | 0.77 | 1.25 | 1.81 |

TABLE 2-continued

| | Color Density after Treatment at 40° C., 90% RH for 24 hrs. | | | | |
|---|---|---|---|---|---|
| | Fog in background area | Record image Recording pulse width (msec) | | | |
| | | 0.8 | 1.0 | 1.2 | 1.6 |
| Com. Ex. 1 | 0.17 | 0.19 | 0.43 | 1.12 | 1.81 |
| Com. Ex. 2 | 0.15 | 0.20 | 0.46 | 1.18 | 1.78 |
| Com. Ex. 3 | 0.32 | 0.40 | 0.71 | 1.19 | 1.75 |
| Com. Ex. 4 | 0.15 | 0.23 | 0.53 | 1.02 | 1.65 |
| Com. Ex. 5 | 0.18 | 0.19 | 0.35 | 1.05 | 1.65 |
| Com. Ex. 6 | 0.09 | 0.35 | 0.66 | 1.14 | 1.61 |

TABLE 3

| | Color Density after Treatment at 20° C., 90% RH for 7 days. | | | | |
|---|---|---|---|---|---|
| | Fog in background area | Record image Recording pulse width (msec) | | | |
| | | 0.8 | 1.0 | 1.2 | 1.6 |
| Ex. 1 | 0.07 | 0.38 | 0.74 | 1.24 | 1.80 |
| Ex. 2 | 0.06 | 0.36 | 0.72 | 1.20 | 1.80 |
| Ex. 3 | 0.07 | 0.25 | 0.60 | 1.17 | 1.75 |
| Ex. 4 | 0.08 | 0.26 | 0.62 | 1.18 | 1.77 |
| Ex. 5 | 0.06 | 0.25 | 0.59 | 1.15 | 1.74 |
| Ex. 6 | 0.08 | 0.26 | 0.58 | 1.15 | 1.73 |
| Ex. 7 | 0.07 | 0.38 | 0.73 | 1.22 | 1.80 |
| Ex. 8 | 0.07 | 0.24 | 0.60 | 1.16 | 1.75 |
| Ex. 9 | 0.06 | 0.23 | 0.57 | 1.13 | 1.73 |
| Ex. 10 | 0.08 | 0.40 | 0.78 | 1.30 | 1.81 |
| Ex. 11 | 0.07 | 0.40 | 0.77 | 1.27 | 1.81 |
| Ex. 12 | 0.10 | 0.41 | 0.81 | 1.31 | 1.81 |
| Ex. 13 | 0.09 | 0.39 | 0.77 | 1.26 | 1.80 |
| Ex. 14 | 0.07 | 0.39 | 0.80 | 1.31 | 1.84 |
| Ex. 15 | 0.09 | 0.42 | 0.81 | 1.28 | 1.82 |
| Ex. 16 | 0.09 | 0.36 | 0.77 | 1.26 | 1.78 |
| Ex. 17 | 0.08 | 0.34 | 0.72 | 1.23 | 1.75 |
| Ex. 18 | 0.07 | 0.40 | 0.77 | 1.29 | 1.81 |
| Ex. 19 | 0.08 | 0.41 | 0.77 | 1.30 | 1.82 |
| Ex. 20 | 0.08 | 0.29 | 0.63 | 1.14 | 1.72 |
| Ex. 21 | 0.08 | 0.22 | 0.52 | 1.02 | 1.67 |
| Ex. 22 | 0.07 | 0.39 | 0.73 | 1.23 | 1.79 |
| Ex. 23 | 0.08 | 0.39 | 0.74 | 1.25 | 1.78 |
| Com. Ex. 1 | 0.12 | 0.14 | 0.25 | 0.73 | 1.25 |
| Com. Ex. 2 | 0.11 | 0.17 | 0.32 | 0.82 | 1.37 |
| Com. Ex. 3 | 0.22 | 0.26 | 0.53 | 1.02 | 1.67 |
| Com. Ex. 4 | 0.14 | 0.20 | 0.48 | 0.97 | 1.63 |
| Com. Ex. 5 | 0.13 | 0.15 | 0.19 | 0.45 | 1.12 |
| Com. Ex. 6 | 0.07 | 0.32 | 0.62 | 1.08 | 1.57 |

Tables 1 to 3 reveal that the heat sensitive recording materials of the invention are excellent in the preservability of recorded images, especially in the preservability of halftone, are free from fogging and have high storage stability.

We claim:

1. A heat sensitive recording material comprising a heat sensitive recording layer formed on a substrate and containing a color former and a color developer reactive with the color former, an intermediate layer formed on the recording layer and containing a water-soluble resin or water-dispersible resin, and an overcoat layer formed on the intermediate layer and containing a resin curable with an ionizing radiation, said color developer comprising at least one compound selected from the group consisting of salicylic acid derivatives represented by formula (1), salicylic acid derivatives represented by formula (2) and polyvalent metal salts of said derivatives

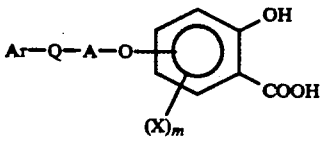

(1)

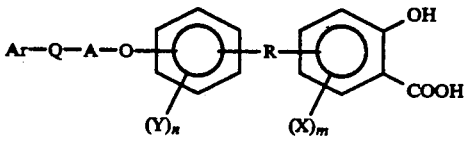

(2)

where Ar is selected from the group consisting of unsubstituted phenyl, substituted phenyl, substituted naphthyl, unsubstituted naphthyl, substituted heterocyclic aromatic groups, unsubstituted heterocyclic aromatic groups, Q is an ether linkage or sulfonyl linkage, A is branched or straight-chain alkylene, cycloalkylene, or alkylene having an arylene bond, R is branched or unbranched alkylene, X is a hydrogen atom, alkyl, cycloalkyl, alkenyl, aralkyl, aryl, alkoxyl, aryloxy, nitro or halogen atom, Y is a hydrogen atom, alkyl, alkenyl, aralkyl or halogen atom, m is an integer of 1 to 3, and n is an integer of 1 to 4.

2. A heat sensitive recording material as defined in claim 1 wherein Ar is phenyl or phenyl substituted with at least one substituent selected from the group consisting of $C_{1\sim6}$ alkyl groups, $C_{1\sim6}$ alkoxyl groups, $C_{7\sim10}$ aralkyl groups, $C_{7\sim10}$ aralkyloxy groups, chlorine atom, bromine atom and fluorine atom, A is $C_{1\sim12}$ alkylene groups or $C_{1\sim12}$ alkylene groups having an ether linkage, R is branched or unbranched alkylene group having 1 to 12 carbon atoms, X is hydrogen atom, $C_{1\sim6}$ alkyl groups, $C_{7\sim10}$ aralkyl groups, $C_{1\sim6}$ alkoxyl groups, phenyl group, phenoxy group, chlorine atom, bromine atom or fluorine atom, Y is hydrogen atom, $C_{1\sim6}$ alkyl groups, $C_{2\sim6}$ alkenyl groups, $C_{7\sim10}$ aralkyl groups, chlorine atom, bromine atom or fluorine atom.

3. A heat sensitive recording material as defined in claim 2 wherein Ar is phenyl or phenyl substituted with at least one substituent selected from the group consisting of $C_{1\sim4}$ alkyl groups, $C_{1\sim4}$ alkoxy groups and chlorine atom, A is $C_{2\sim6}$ alkylene groups, R is branched or unbranched alkylene group having 2 to 6 carbon atoms, X is hydrogen atom, Y is hydrogen atom.

4. A heat sensitive recording material as defined in claim 1 wherein the recording layer further contains a metal compound.

5. A heat sensitive recording material as defined in claim 4 wherein the metal compound is used in an amount of 1 to 500 parts by weight per 100 parts by weight of the color developer represented by the formula 1 or 2 or the polyvalent metal salt thereof.

6. A heat sensitive recording material as defined in claim 1 wherein the color developer represented by the formula 1 or 2 or the polyvalent metal salt thereof is used in an amount of 50 to 700 parts by weight per 100 parts by weight of the color former.

7. A heat sensitive recording material as defined in claim 1 wherein the substrate is plastic film or synthetic paper.

8. A heat sensitive recording material as recited in claim 1, wherein A is selected from branched or straight-chained alkylene having an ether linkage, ester linkage, amide linkage or unsaturated bond; cycloalkylene having an ether linkage, ester linkage or amide linkage; or alkylene having an arylene bond and having an ether linkage, ester linkage or amide linkage.

9. A heat sensitive recording material as recited in claim 1, wherein A is selected from branched or straight-chained alkylene having no ether linkage, ester linkage, amide linkage or unsaturated bond; cycloalkylene having no ether linkage, ester linkage or amide linkage; or alkylene having an arylene bond and having no ether linkage, ester linkage or amide linkage.

* * * * *